US010996031B1

(12) United States Patent
Stout

(10) Patent No.: US 10,996,031 B1
(45) Date of Patent: May 4, 2021

(54) FREE SPINNING HUB FOR MORTAR PROJECTILES

(71) Applicant: U.S. Government as Represented by the Secretary of the Army, Dover, NJ (US)

(72) Inventor: Christopher Stout, Marlboro, NJ (US)

(73) Assignee: U.S. Government as Represented by the Secretary of the Army, Washington, DC (US)

( * ) Notice: Subject to any disclaimer, the term of this patent is extended or adjusted under 35 U.S.C. 154(b) by 413 days.

(21) Appl. No.: 16/043,462

(22) Filed: Jul. 24, 2018

Related U.S. Application Data

(60) Provisional application No. 62/537,054, filed on Jul. 26, 2017.

(51) Int. Cl.
*F42B 10/02* (2006.01)
*F42B 10/64* (2006.01)

(52) U.S. Cl.
CPC ..... *F42B 10/02* (2013.01); *F42B 10/64* (2013.01)

(58) Field of Classification Search
CPC ..... F24B 10/02; F24B 10/64
See application file for complete search history.

(56) References Cited

U.S. PATENT DOCUMENTS

| | | | | | |
|---|---|---|---|---|---|
| 4,964,593 | A * | 10/1990 | Kranz | F42B 10/64 | 102/208 |
| 5,452,864 | A * | 9/1995 | Alford | F42B 10/26 | 244/3.23 |
| 5,780,766 | A * | 7/1998 | Schroppel | F42B 12/16 | 102/372 |
| 6,443,391 | B1 * | 9/2002 | Malejko | F42B 10/06 | 244/3.1 |
| 9,086,258 | B1 * | 7/2015 | Vasudevan | F41G 7/2293 | |
| 2012/0017795 | A1 * | 1/2012 | Dryer | F42B 10/16 | 102/526 |

OTHER PUBLICATIONS

Rider, Excalibur: Turning "artillery cannon into sniper rifle", Article, Mar. 2, 2011, United States Army, Picatinny Arsenal, NJ.

* cited by examiner

*Primary Examiner* — Justin M Benedik
(74) *Attorney, Agent, or Firm* — John P. DiScala

(57) ABSTRACT

A precision guided munition with a fin assembly comprising a free spinning hub to which the fins attach addresses the need to roll control a projectile while eliminating the problems of the fin kit. The fin hub, to which the fins are attached, is radially decoupled from the mortar tail boom thus allowing it and the fins to spin freely relative to the body without coupling any of the spin. Advantageously, the need for a bearing between the hub and the tail boom is negated.

16 Claims, 3 Drawing Sheets

FREE SPINNING HUB FOR MORTAR PROJECTILES

CROSS-REFERENCE TO RELATED APPLICATIONS

This application claims the benefit under 35 USC § 119(e) of U.S. provisional patent application 62/537,054 filed on Jul. 26, 2017.

STATEMENT OF GOVERNMENT INTEREST

The inventions described herein may be manufactured, used and licensed by or for the United States Government.

BACKGROUND OF THE INVENTION

The invention relates in general to precision guided projectiles and in particular to fin stabilized precision guided projectiles.

Mortars are an indirect firing capability used to defeat enemy troops, materiel, bunkers and other infantry-type targets. Conventional mortars typically require warfighters to fire multiple rounds as they adjust fire to accurately hit their target. Precision guided mortars, in contrast, allow for more precise engagement of a target than conventional mortars.

Precision guided mortars are necessary when warfighters can't afford for a mortar round to be off target, such as in an urban environment where there is a potential for collateral damage. By allowing for mortar fire in an otherwise off-limits environment, warfighters may not have to risk engaging targets with direct-fire weapons. Additionally, a precision mortar fire allows an operator to effectively engage a target in a shorter amount of time thereby allowing them to reposition before receiving counter-fire. Finally, precision guided mortars reduce the logistical burden for troops as troops as the quantity of rounds fired may be reduced thereby reducing the quantity of rounds that must be supplied, stored and carried.

For precision guided mortars, typically an initial phase of ballistic flight exists on the up-leg and then a roll controlled guided phase occurs after apogee. To implement the control scheme on the round, it is necessary to control the roll of the airframe during the guided phase. Precision munitions that use deflectable canards to create maneuvers experience a reduction in their control authority in the roll direction due to roll torque created by the fins, either by design or due to tolerance asymmetries, and by downwash effects of the canard on their fins.

Fin stabilized projectiles, such as mortars, typically use small fin cant angle or beveled edges to generate a small amount of roll torque on the airframe to aid in stability and reduce ballistic dispersion. Any fin induced roll torque needs to be fought by the canard actuation system which executes the roll control and thus takes away from the overall maneuverability. Eliminating all of the roll torque completely from the fins is one solution; however this requires costly machining and inspection of the piece parts and assemblies to ensure no small asymmetries exist.

However, even if all of the roll torque induced by the fins alone can be eliminated, undesirable roll commands are still induced by the canard-fin interaction. Downwash effects on the fins causing a pressure differential to develop on the fins which in turn reduces roll control authority. This is especially an issue for projectiles with shorter bodies, such as mortar rounds, as opposed to longer rounds like rockets. In shorter rounds, the flow has less travel distance to normalize before the fins.

There exists a need for a precision guided projectile which can mitigate roll control issues caused by deflectable canards while maintaining canard control of the weapon.

SUMMARY OF INVENTION

One aspect of the invention is a fin assembly for a fin stabilized projectile. The fin assembly includes a fin hub to which one or more fins are attached. The fin assembly is radially decoupled from a tail boom of the fin stabilized projectile thereby allowing the fin assembly to spin freely relative to a body of the fin stabilized projectile.

Another aspect of the invention is a precision guided mortar. The precision guided mortar comprises a body, a canard set, a tail boom, a fin assembly and an igniter assembly. The canard set extends radially beyond the body to execute control commands. The tail boom extends axially from a rear of the body. The fin assembly is slidingly fit over the tail boom and comprises a fin hub to which one or more fins are attached. The fin assembly is radially decoupled from the tail boom of the mortar thereby allowing the fin assembly to spin freely relative to the tail boom and the body. The igniter assembly is inserted into the tail boom and further includes an igniter head which extends beyond the tail boom to restrain the fin assembly in an axial direction.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

A precision guided munition with a fin assembly comprising a free spinning hub to which the fins attach addresses the need to roll control a projectile while eliminating fin induced roll torque due to the fins and the fin-canard interaction. The fin hub, to which the fins are attached, is radially decoupled from the mortar tail boom, or cartridge boom, thus allowing it and the fins to spin freely relative to the body without coupling any of the spin to the body. Advantageously, the fin hub is decoupled without the use of a bearing. Bearings are costly, complicated and are not be suitable for applications with limited space such as a mortar round. Additionally, for mortars the fin and hub assembly sits in the chamber embedded with the propellant. During firing the particulates generated make for an increased propensity to binding for any type of bearing system.

Figure 1:
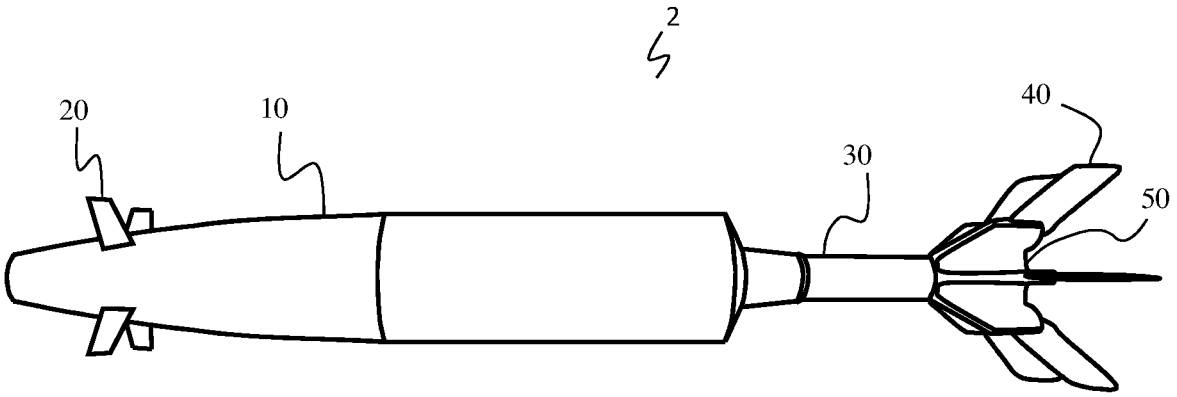
FIG. 1 is a side view of a precision guided mortar projectile, in accordance with an illustrative embodiment.

FIG. 1 is a side view of a precision guided mortar projectile, in accordance with an illustrative embodiment. The projectile 2 comprises a body 10, a canard set 20, a tail boom 30, a fin assembly 40 and an igniter assembly 50. The body 10 of the projectile 2 contains the payload and guidance electronics. The canard set 20 extends beyond the body 10 and controls projectile flight by deflecting in a coordinated way to produce aerodynamic moments about the projectile center of gravity.

The tail boom 30 extends axially from the body 10 of the projectile 2. The tail boom 30 is a long hollow cylinder which receives the igniter assembly 50 within the cylindrical opening and the fin assembly 40 on the outer surface. In addition, the tail boom 30 provides a mounting surface for the fin assembly 40 and additional propelling charges. As will be described further below, the fin assembly 40 comprises a fin hub and one or more attached fins. The igniter provides a propelling charge for the mortar and further serves to restrain the fin assembly 40 on one side in the axial direction.

While the projectile 2 shown in FIG. 1 and described throughout is a 120 mm mortar projectile, the projectile 2 is not limited to 120 mm projectiles. For example, the munition may be a different type mortar projectile such as a 60 mm or 81 mm mortar projectile or a different munition, such as an artillery round or rocket. Additionally, the projectile 2 is not limited to munitions. The projectile 2 may be any fin stabilized projectile with precision guidance provided by control surfaces.

Figure 2:
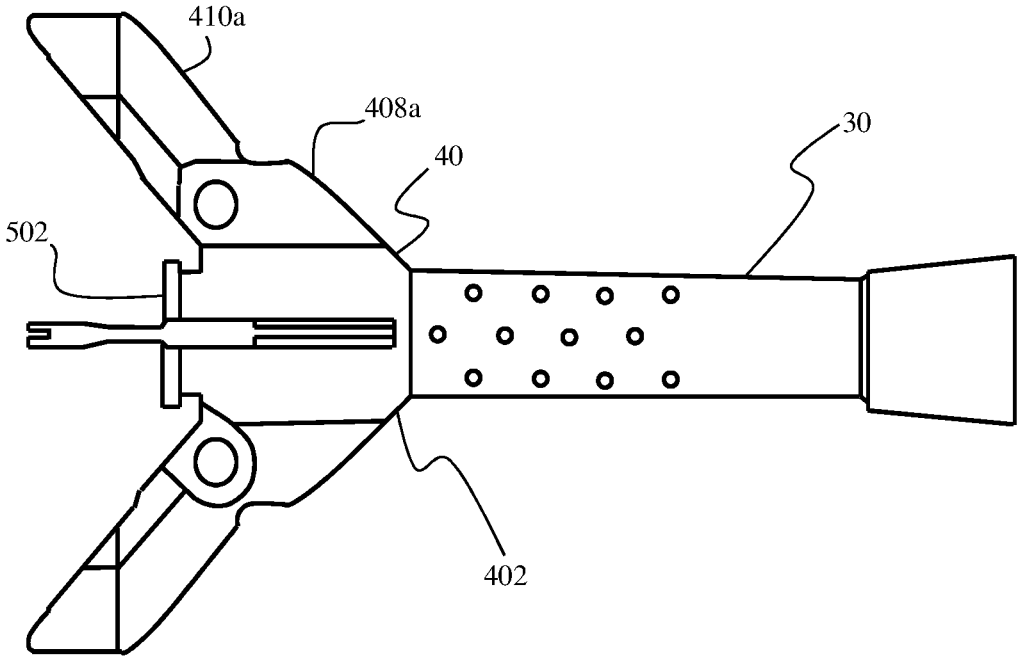
FIG. 2 is a side view of a tail boom assembly of a precision guided weapon, in accordance with an illustrative embodiment.
Figure 3:
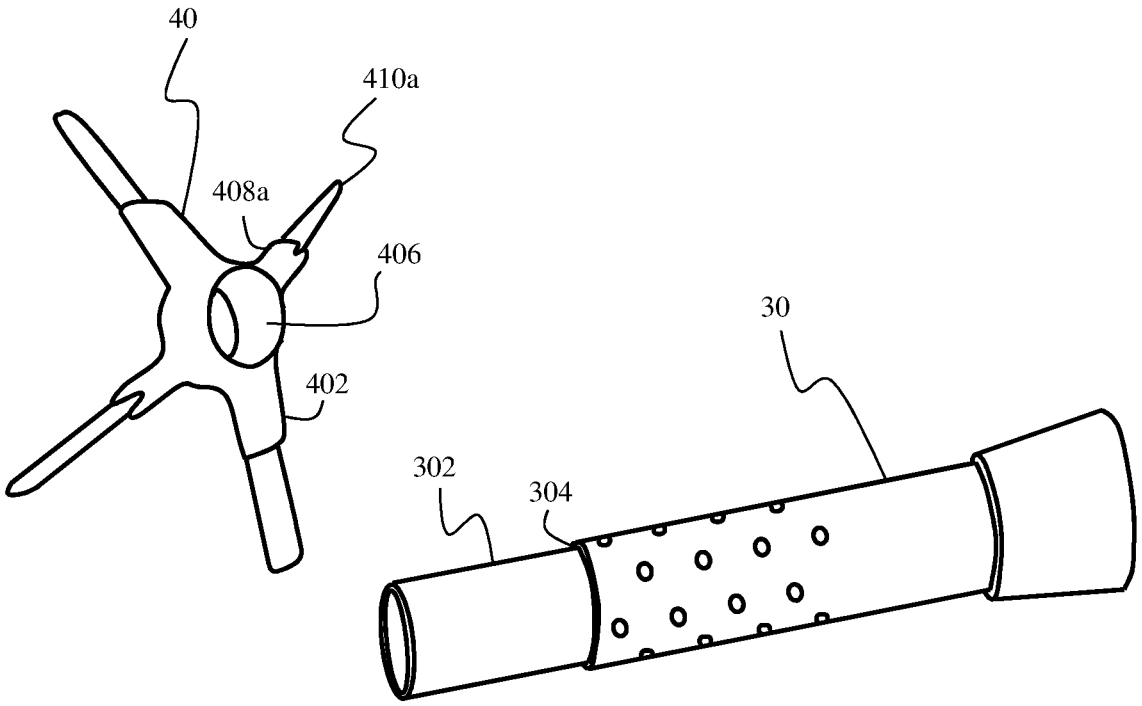
FIG. 3 is an exploded view of a tail boom assembly of a precision guided weapon, in accordance with an illustrative embodiment.

FIG. 2 is a side view of a tail boom and fin assembly of a precision guided weapon, in accordance with an illustrative embodiment of the invention. FIG. 3 is an exploded view of the tail boom and fin assembly, in accordance with an illustrative embodiment of the invention. The fin assembly 40 provides stability to the projectile 2 while in flight. The fins are designed to impart a roll torque on the fin assembly 40 through either, or both, cant angles on the tips and beveled edges. In the embodiment shown, the fin assembly 40 achieves a roll rate of greater than approximately ten Hertz. The fin assembly 40 is radially decoupled from the mortar tail boom 30 thus allowing it to spin freely relative to the body 10 and tail boom 30 without coupling any of the spin to these components.

The fin assembly 40 comprises a hub 402 to which one or more fins 410 are attached. The fin hub 402 has a body 404 defining a hollow cylindrical interior 406 sized and dimensioned to fit over the tail boom 30 of the projectile 2. One or more fins 410 extend radially outward from the fin hub 402. To generate a significant amount of roll torque on the fin assembly 40, each of the fins 410 have a cant angle on their tip and leading and trailing edge bevels.

In the embodiment shown in FIGS. 2 and 3, the fin hub 402 has four protrusions 408 arranged symmetrically around the cylindrical body 404 and which extend radially outward. These protrusions 408 serve as mounting surfaces for corresponding fins 410 which align with the protrusions 408 and extend further radially. In other embodiments, the fin assembly 40 may be one integral unit.

Additionally, while the fin assembly 40 shown in FIGS. 2 and 3 comprises four fins 410 arranged symmetrically around the hub 402 in a cruciform arrangement, the fin assembly 40 is not limited to any specific number or arrangement of fins 410. The fin assembly 40 may comprise less than four fins 410 or more than four fins 410 depending on the application and desired performance. For example, the fin assembly 40 shown in FIG. 1 comprises six fins 410 arranged symmetrically around the hub 402.

The tail boom 30 extends axially from the body 10 of the projectile 2. The fin hub 402 is sized and dimensioned to fit slidingly over a portion of the outer surface 302 of the tail boom 30. A 0.003"-0.008" radial gap exists between the inner diameter of the hub 402 and the outer diameter of the tail boom 30. In an embodiment, the fin hub 402 is held in place axially on the tail boom 30 between the standard igniter head 502 on the M1020 ignition assembly 50 and a lip 304 formed between portions of varying diameter on the outer surface and extending around the tail boom 30. When the ignition assembly 50 is inserted into the hollow interior of the tail boom 30, the igniter head 502 extends beyond the tail boom 30 thereby creating a flange which restrains the fin assembly 40 in the axial direction.

The fin assembly 40 is able to decouple from the tail boom 30 and spin freely without a bearing due to the small radial gap between the tail boom 30 and the fin assembly 40 in combination with both a large inertial mismatch between the hub 402 and body 10 and the significant roll torque on the fin assembly 40. A substantial polar moment of inertia mismatch exists between the fin assembly 40 and the tail boom 30 and a body 10 of the projectile 2 due to the design of these components. In the embodiments shown in FIGS. 1-3, the polar moment of inertia of the body 10 is approximately twenty-nine times greater than the polar moment of inertia of the fin assembly 40. In addition, the mass damping provided by the inertial mismatch also may aid any active control system used to completely remove rolling motion in the forward assembly.

Further, the cant angle on the fin tips and the beveled leading and trailing edges of the fins 410 impart a significant roll torque on the fin assembly 40. Along with the polar moment mismatch, these two factors ensure that the fins 410 spin up to their fill rate quickly and that any kinetic friction between the sliding surfaces does not significantly reduce the spin rate.

While the invention has been described with reference to certain embodiments, numerous changes, alterations and modifications to the described embodiments are possible without departing from the spirit and scope of the invention as defined in the appended claims, and equivalents thereof.

What is claimed is:

1. A fin assembly for a fin stabilized projectile comprising a fin hub to which one or more fins are attached and which is radially decoupled from a tail boom of the fin stabilized projectile thereby allowing the fin assembly to spin freely relative to a body of the fin stabilized projectile wherein the fin hub is slidingly fit over the tail boom.

2. The fin assembly of claim 1 wherein the fin assembly is axially restrained by an igniter head of the fin stabilized projectile.

3. The fin assembly of claim 1 wherein a radial gap between the inner diameter of the fin assembly and the outer diameter of the tail boom is in the range of approximately 0.003 inches to approximately 0.008 inches.

4. The fin assembly of claim 1 wherein a mismatch between a polar moment of inertia of the fin assembly and a polar moment of inertia of the tail boom and a body of the fin stabilized projectile allows the fin assembly to spin freely relative to the body of the fin stabilized projectile.

5. The fin assembly of claim 4 wherein the polar moment of the fin assembly is approximately twenty-nine times less than the polar moment of inertia of the tail boom and the body.

6. The fin assembly of claim 1 wherein a spin rate mismatch between the fin assembly and the tail boom and a body of the fin stabilized projectile allows the fin assembly to spin freely relative to the body of the fin stabilized projectile.

7. The fin assembly of claim 6 wherein the one or more fins each comprise a tip with a cant angle to achieve a desired spin rate.

8. The fin assembly of claim 6 wherein each of the one or more fins comprise a beveled leading edge and a beveled trailing edge to achieve a desired spin rate.

9. The fin assembly of claim 1 wherein the fin stabilized projectile is a mortar projectile.

10. A precision guided mortar comprising:

a body;

a canard set extending radially beyond the body to execute control commands;

a tail boom extending axially from a rear of the body;

a fin assembly slidingly fit over the tail boom and comprising a fin hub to which one or more fins are attached and which is radially decoupled from a tail boom of the mortar thereby allowing the fin assembly to spin freely relative to the tail boom and the body;

an igniter assembly inserted into the tail boom and further comprising an igniter head which extends beyond the tail boom to restrain the fin assembly in an axial direction.

11. The fin assembly of claim 10 wherein a radial gap between the inner diameter of the fin assembly and the outer diameter of the tail boom is in the range of approximately 0.003 inches to approximately 0.008 inches.

12. The fin assembly of claim 10 wherein a polar moment of inertia mismatch between the fin assembly and the tail boom and body of the fin stabilized projectile allows the fin assembly to spin freely relative to the body.

13. The fin assembly of claim 12, wherein the polar moment of the fin assembly is approximately twenty-nine times less than the polar moment of inertia of the tail boom and body.

14. The fin assembly of claim 10 wherein a spin rate mismatch between the fin assembly and the tail boom and body allows the fin assembly to spin freely relative to the body.

15. The fin assembly of claim 14 wherein the one or more fins each comprise a tip with a cant angle to achieve a desired spin rate.

16. The fin assembly of claim 14 wherein each of the one or more fins comprise a beveled leading edge and a beveled trailing edge to achieve a desired spin rate.

* * * * *